US009228787B2

(12) United States Patent
Wood et al.

(10) Patent No.: US 9,228,787 B2
(45) Date of Patent: Jan. 5, 2016

(54) POLYMERIC SLEEVE VIBRATION DAMPER FOR THE ACTION SPRING OF AR-10 DERIVATIVE RIFLES

(71) Applicants: Thomas Lee Wood, St. David, AZ (US); William Jeremy Wood, Layton, UT (US)

(72) Inventors: Thomas Lee Wood, St. David, AZ (US); William Jeremy Wood, Layton, UT (US)

( * ) Notice: Subject to any disclaimer, the term of this patent is extended or adjusted under 35 U.S.C. 154(b) by 0 days.

(21) Appl. No.: 14/171,764

(22) Filed: Feb. 3, 2014

(65) Prior Publication Data

US 2014/0373708 A1 Dec. 25, 2014

Related U.S. Application Data

(60) Provisional application No. 61/760,081, filed on Feb. 3, 2013.

(51) Int. Cl.
*F41A 5/00* (2006.01)
*F41A 3/84* (2006.01)

(52) U.S. Cl.
CPC ..... *F41A 3/84* (2013.01)

(58) Field of Classification Search
USPC ..... 89/198, 191.01, 191.02, 125, 199; 42/2, 42/1.06
See application file for complete search history.

(56) References Cited

U.S. PATENT DOCUMENTS

| | | | | |
|---|---|---|---|---|
| 5,887,395 | A * | 3/1999 | Navarro et al. | 52/232 |
| 6,223,928 | B1 * | 5/2001 | Sheran et al. | 220/495.11 |
| 7,854,221 | B1 * | 12/2010 | Gore | 124/63 |

* cited by examiner

*Primary Examiner* — J. Woodrow Eldred
(74) *Attorney, Agent, or Firm* — Angus C. Fox, III

(57) ABSTRACT

A vibration-dampening polymeric sleeve is provided for installation within the tubular receiver extension of an AR-10 derivative assault rifle before the action spring and buffer are installed therein. The presence of the sleeve dampens noise and vibration caused by the action spring of an AR-10 derivative assault rifle slapping against the cylindrical wall of the receiver extension. For one embodiment of the sleeve, a generally rectangular sheet of laminar polymeric plastic material equipped with tabs at the rear thereof, that is rolled into a tube. The tabs, which are inwardly bent, are held against the closed, rear end of the receiver extension by the action spring, whether the spring is fully compressed or only partially compressed. For an alternative embodiment, the sleeve, a solvated liquid polymer compound is sprayed into the cylindrical chamber of an axially-rotating receiver extension and allowed to dry.

7 Claims, 3 Drawing Sheets

POLYMERIC SLEEVE VIBRATION DAMPER FOR THE ACTION SPRING OF AR-10 DERIVATIVE RIFLES

BACKGROUND OF THE INVENTION

1. Field of the Invention

The present invention relates, generally, to rifle buttstock stabilization devices and, more particularly, to devices designed to enhance repeatability, uniformity and stability associated with aiming and discharging shoulder-fired rifles.

2. History of the Prior Art

An assault rifle is a gas-operated rifle designed for combat that can be selectively fired in both fully-automatic and semi-automatic modes. Assault rifles are the standard infantry weapons in most modern armies, having largely superseded or supplemented larger and more powerful battle rifles such as the M14, FN FAL and the Heckler & Koch G3. Examples of assault rifles include the AK-47, the M16, the M4 and the Steyr AUG.

The German military developed the assault rifle concept during World War II, based upon research that showed that most firefights happen at a range of less than 300 meters. The power and range of contemporary rifle cartridges was excessive for most small arms firefights. As a result, the German military sought a cartridge and rifle combining submachine gun features (large-capacity magazine, selective-fire) with an intermediate-power cartridge effective to 300 meters. To reduce manufacturing costs, the 7.92×57 mm Mauser cartridge case was shortened, the result of which was the lighter 7.92×33 mm Kurz (short). The Sturmgewehr model 1944 (storm rifle model 1944, usually abbreviated StG44), is generally considered by historians to be the first modern assault rifle. Developed in Nazi Germany toward the end of World War II, it was the first of its kind to see major deployment. Though derided by the allied forces for its heavy receiver and fully-automatic fire capability, the StG44 fulfilled its role admirably, particularly on the Eastern Front, by offering greatly-increased concentration of fire, as compared to standard infantry rifles then in use. Fortunately, it arrived too late to have a significant effect on the outcome of the war.

Mikhail Kalashnikov began his career as a weapon designer while in a hospital after being wounded during the rout of Soviet troops by the German forces at the Battle of Bryansk. While recovering from his injuries, Kalashnikov experienced repeated flashbacks of the battle, and became obsessed with creating a submachine gun that would drive the Germans from his homeland. After tinkering with a submachine gun design for some time, he entered a 1944 com petition for a new weapon that would chamber the 7.62×41 mm cartridge developed by Elisarov and Semin in 1943. A particular requirement of the competition was that the firearm be serviceable and reliable in the muddy, wet, and frozen conditions of the Soviet frontline. The Kalashnikov entry—a carbine bearing a strong design resemblance to the American M1 Garand—lost out to a Simonov design that would later become the SKS semi-automatic carbine. However, in response to a subsequent design competition in 1946, Kalashnikov and his design team submitted a redesign of his original carbine. The gas-operated rifle which his team entered is most aptly described as a hybrid of the best rifle technology of the period. His design incorporated the trigger, double locking lugs and unlocking raceway of the M1 Garand/M1 carbine; the safety mechanism of the Browning-designed Remington Model 8 rifle; and the gas system and layout of the StG44. Sixty years after its acceptance by the Soviet military in 1947, the iconic Avtomat Kalashnikova Model 1947 (shortened to AK-47) remains the most widely-used assault rifle in the world. More AK-type rifles have been produced than all other assault rifles combined. The main advantages of the Kalashnikov rifle are its simple design, fairly compact size and adaptability to mass production. It is inexpensive to manufacture, and easy to clean and maintain. In addition, its ruggedness and reliability are legendary. The large gas piston, generous clearances between moving parts, and tapered cartridge case design allow the gun to endure large amounts of foreign matter and fouling without failing to cycle. However, this reliability comes at the cost of accuracy, as the looser tolerances do not allow for precision and consistency.

The M14 rifle is an American selective-fire automatic rifle that chambers 7.62×51 mm NATO ammunition. It was the standard issue US rifle until 1970. The M14 was used for US Army and Marine Corps basic and advanced individual training, and was the standard issue infantry rifle in CONUS, Europe, and South Korea, until replaced by the M16 rifle in 1970. It remains in limited front line service with the United States Army, Marine Corps, Navy, and Air Force, and remains in use as a ceremonial weapon. It was the last so-called "battle rifle" (a term applied to weapons firing full-power rifle ammunition) issued in quantity to U.S. troops. The M14 was developed from a long line of experimental weapons based upon the M1 Garand, the first successful semi-automatic rifle to be put into active military service. Designed by Canadian-born John C. Garand while employed as a consulting engineer by the U.S. Springfield Armory, the M1 was standard issue for U.S. soldiers during World War II. Though among the most advanced infantry rifles of the 1940s, it was not a perfect weapon. It primary detractions were its length, its mass, its heavy ammunition, and its lack of a fully-automatic mode. Toward the end of the war, modifications were made to the basic design which addressed the final detraction. Those modifications included the incorporation of fully-automatic firing capability and replacing the 8-round "en bloc" clips with a detachable box magazine holding 20 rounds. John Garand's T20 conversion was the most widely-used of the fully-auto M1 variants. However, it soon became evident that the size and weight attributes of the basic M1 design required a more radical approach. Earle Harvey and Lloyd Corbett, both employees of the Springfield Armory, were instrumental in designing rifles for the new .30 Light Rifle cartridge, which was based upon .30-06 cartridge case cut down to the length of the .300 Savage case. The .30 Light Rifle eventually evolved into the 7.62×51 mm NATO and the commercial .308 Winchester round. Although shorter than the .30-06, the 7.62×51 mm NATO round retained the same power due to the use of modern propellants. Harvey was instrumental in designing a completely new T25 rifle prototype, while Corbett was tasked with developing .30 Light Rifle conversions of the M1 and T20 designs. Corbett's original T44 prototype used a T20 receiver rebarreled for the NATO 7.62 mm round. In addition, the long operating rod/piston of the M1 was replaced with the T25's shorter "gas expansion and cut-off" system. The T44 design evolved to use newly-fabricated receivers that were shorter than those of either the M1 or T20. The new action's length was matched to the shorter 7.62 mm NATO cartridge instead of the longer .30-06. Corbett's more conservative approach ultimately prevailed during design competitions that began in 1954, and the T44 was adopted by the U.S. military as the M14 in 1957. Springfield Armory began tooling a new production line in 1958 and delivered the first service rifles to the U.S. Army in July 1959.

Acceptance of the M14 did not occur before a radical newcomer entered the contest. In 1954, Eugene M. Stoner became chief engineer of newly-formed ArmaLite, a division of Fairchild Engine & Airplane Corporation. Stoner was primarily responsible for the development of the 7.62 mm AR-10. Springfield's T44 and similar entries were conventional rifles that used wood for the buttstock and which were built entirely of steel using mostly forged and machined parts. ArmaLite was founded specifically to bring the latest in designs and alloys to firearms design, and Stoner felt he could easily beat the other offerings. Stoner's AR-10 was radical for its day. The receiver was made of forged and milled aluminum alloy instead of steel. The barrel was mated to the receiver by a separate hardened steel extension to which the bolt locked. This allowed a lightweight aluminum receiver to be used while still maintaining a steel-on-steel lockup. Whereas on traditional semi-automatic rifles, the action is actuated by a cylinder and piston close to a gas vent in the barrel, the bolt on the AR-10 was operated by high-pressure combustion gases taken from a hole in the middle of the barrel, routed directly through a tube above the barrel to a cylinder, with the bolt carrier itself acting as a piston. On the AR-10, the stock and grips were made of a glass-reinforced plastic shell over a rigid foam plastic core. The muzzle brake was fabricated from titanium. The layout of the weapon itself was also somewhat unique. Previous designs generally placed the sights directly on the barrel, using a bend in the stock to align the sights at eye level while transferring the recoil down to the shoulder. This meant that the weapon tended to rise when fired making it very difficult to control during fully-automatic fire. The ArmaLite team used a solution previously used on weapons such as the German FG 42 and Johnson light machine gun; the barrel was in line with the stock, well below eye level, with the sights to eye level. The rear sight was built into a carrying handle over the receiver. The AR-10 was a very advanced design for its time. Despite being over 2 lb (0.9 kg) lighter than the competition, it offered significantly greater accuracy and recoil control. Two prototype rifles were delivered to the U.S. Army's Springfield Armory for testing late in 1956. At this time, the U.S. armed forces were already two years into a service rifle evaluation program, and the AR-10 was a newcomer with respect to older, more fully-developed designs. Unfortunately, ArmaLite's president, George Sullivan, insisted that both prototypes be fitted with barrels made of aluminum extruded over a thin stainless steel liner. Shortly after the aluminum-steel composite barrel burst on one of the prototypes in 1957, the AR-10 was rejected. However, later that same year, General Willard G. Wyman, commander of the U.S. Continental Army Command (CONARC) put together a team to develop a .223 caliber (5.56 mm) weapon. Wyman had seen the AR-10 in an earlier demonstration and, impressed by its performance, personally suggested that ArmaLite enter an AR-10 modified to use a 5.56 mm cartridge designed by Winchester. ArmaLite commissioned Stoner's chief assistant, Robert Fremont, and Jim Sullivan, another employee, with the task of scaling down the basic AR-10 design to fire the small-caliber .223 Winchester cartridge. When improper assembly of the prototypes being tested resulted in CONRAC rejecting the design, Fairchild, which had already spent $1.45 million in development costs with no potential return on the investment, decided to bail out of the small-arms business. Fairchild thereafter sold production rights for the AR-15 to Colt Firearms in December 1959, for a mere $75,000 in cash and a 4.5% royalty on subsequent sales. In 1960, ArmaLite was reorganized, and Stoner left the company. Given such an inauspicious beginning, it would have been difficult to predict that within five years, the AR-15 would be adopted by United States military forces as the M16 rifle, and that it and variants thereof would be in continuous production well into the twenty-first century.

The M4 carbine is a family of firearms tracing its lineage back to earlier carbine versions of the M16, all based on the original AR-15 made by ArmaLite. It is a shorter and lighter version of the M16A2 assault rifle, achieving 80% parts commonality with the M16A2. The M4 has selective fire options including semi-automatic and three-round burst (like the M16A2), while the M4A1 has a "full auto" option in place of the three-round burst.

The AR-15 and M16 rifle designs are derived from the AR-10. As on the AR-10, the bolt on the AR-15 and M16 is operated by high-pressure combustion gases taken from a hole in the middle of the barrel. The gases are routed directly through a tube above the barrel to the front of the bolt carrier, which acts as a piston. The bolt and bolt carrier slide within a receiver extension, which functions as a cylinder. The bolt and bolt carrier slide backwards against a buffer that is inserted in the front end of an action spring that is installed within the receiver extension. The receiver extension, incidentally, is housed within the rifle's buttstock. As the bolt, bolt carrier and buffer slide backwards, the rifle's hammer is reset as an extractor simultaneously pulls the spent casing from the chamber. Once the casing is clear of the chamber, an ejector kicks the casing out of the receiver. The AR-15, M16 and derivative rifles are, thus, gas operated via a method known as direct impingement (DI). The DI system has the advantage of having the absolute minimum of recoiling action parts, resulting in the minimum possible weapon disturbance due to balance shifting during the action cycle as well as reducing overall weapon weight. It has the disadvantage of the propellant gas (and the accompanying fouling) being blown directly into the action parts. DI operation increases the amount of heat that is deposited in the receiver while firing, which can burn off essential lubricants. Lack of proper lubrication is the most common source of weapon stoppages or jams. The bolt, extractor, ejector, pins, and springs are also heated by this high-temperature gas. These combined factors reduce service life of these parts, reliability, and mean time between failures.

What is needed is a method for damping the vibration of the action spring at the moment of maximum compression.

SUMMARY OF THE INVENTION

The present invention provides a solution to the noise and vibration problem caused by the action spring 102 of an AR-15 or derivative thereof slapping against the cylindrical wall of the receiver extension 101. A polymeric sleeve is provided that, during assembly of the rifle action, is inserted into the tubular receiver extension before the action spring and buffer are installed therein. Inwardly-bent tabs at the rear of the sleeve are held against the closed, rear end of the receiver extension by the action spring, whether the spring is fully compressed or only partially compressed. Because generally interchangeable receiver extensions manufactured by different manufacturers vary slightly in internal diameter (though, the sleeve is preferably fabricated from a generally rectangular piece of laminar polymer material that is subsequently rolled into a tube. The width of the piece of laminar polymer material is sized so that a small gap averaging about 0.9 mm (0.035 inch) wide will remain between the adjacent edges of the rolled sheet, no matter from which manufacturer the receiver extension has been procured. If all receiver extensions had identical internal diameters, the sleeve could just as well be formed from a tube having a continuous cylindrical wall (i.e., no gap). For a presently preferred embodiment of the invention, the sleeve is fabricated from polyvinylchloride (PVC) sheeting having a uniform thickness of about 0.3556-

0.381 mm (0.014-0.015 inches). Although a prototype sleeve has been fabricated from PVC sheeting, other polymeric materials such as polyester (PE), high-density polyethylene (HDPE), low-density polyethylene (LDPE), polypropylene (PP), and nylon can also be used to manufacture the sleeve. The nominal internal diameter of the tubular receiver extension is 25.4 mm (1.00 inch). The presently preferred length of the polymeric sleeve is about 3.0 inches (7.62 cm). The presently preferred width of the laminar polymer material from which the sleeve is made is 7.869 cm (3.098 inches). Each of the securing tabs on the rear edge of the laminar polymer material are about 6.35 mm (0.25 inch) wide and 6.35 mm (0.25 inch) long. The securing tabs are positioned so that they will be generally equiangularly spaced about the circumference of the rolled tube.

DETAILED DESCRIPTION OF THE PREFERRED EMBODIMENT

The invention will now be described with reference to the attached drawing figures. It should be understood that the drawings are not necessarily drawn to scale and are intended to be merely illustrative of the invention.

Figure 1:
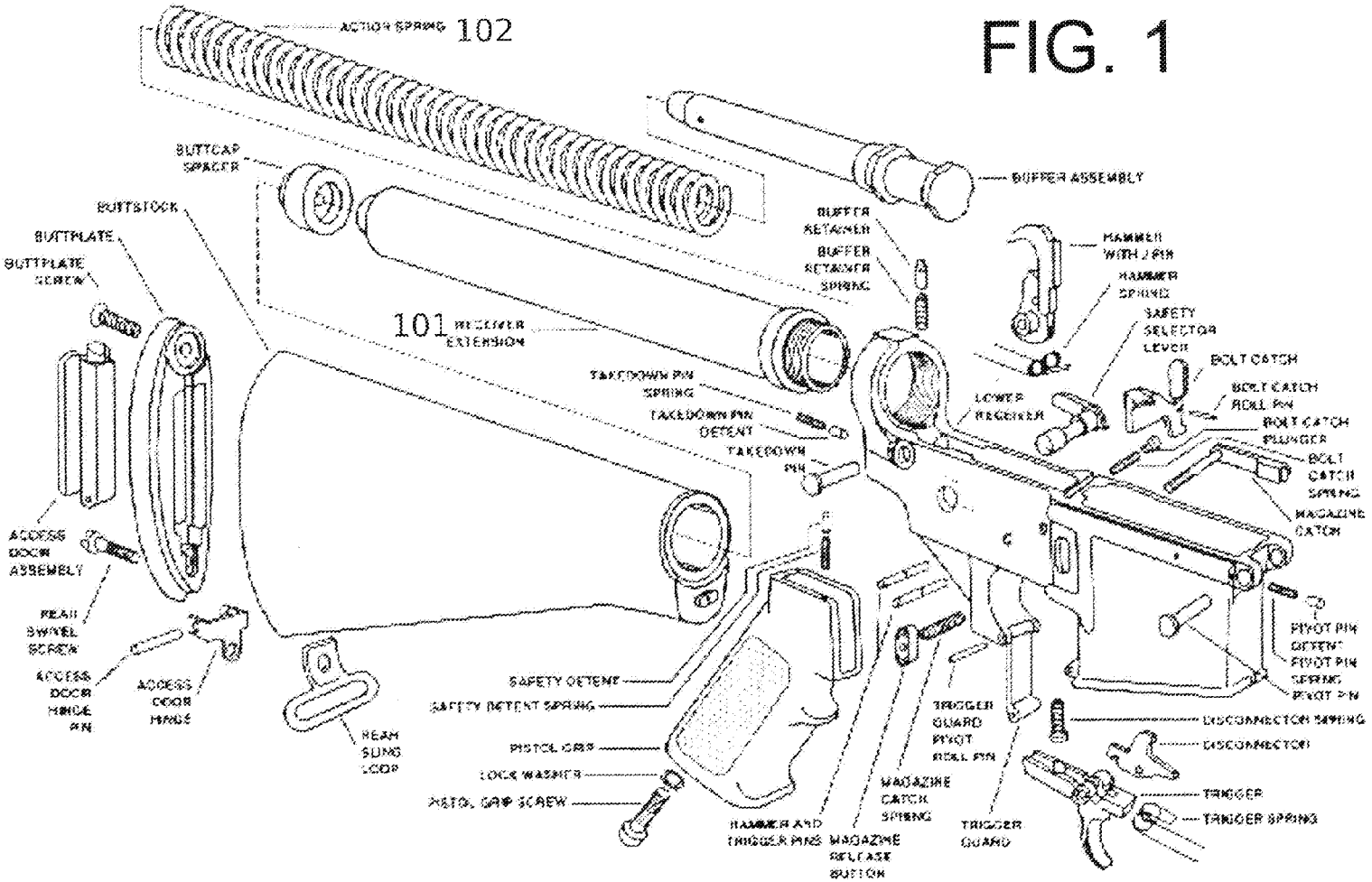
FIG. 1 is an exploded diagram of an AR-15 type rifle.
Figure 2:
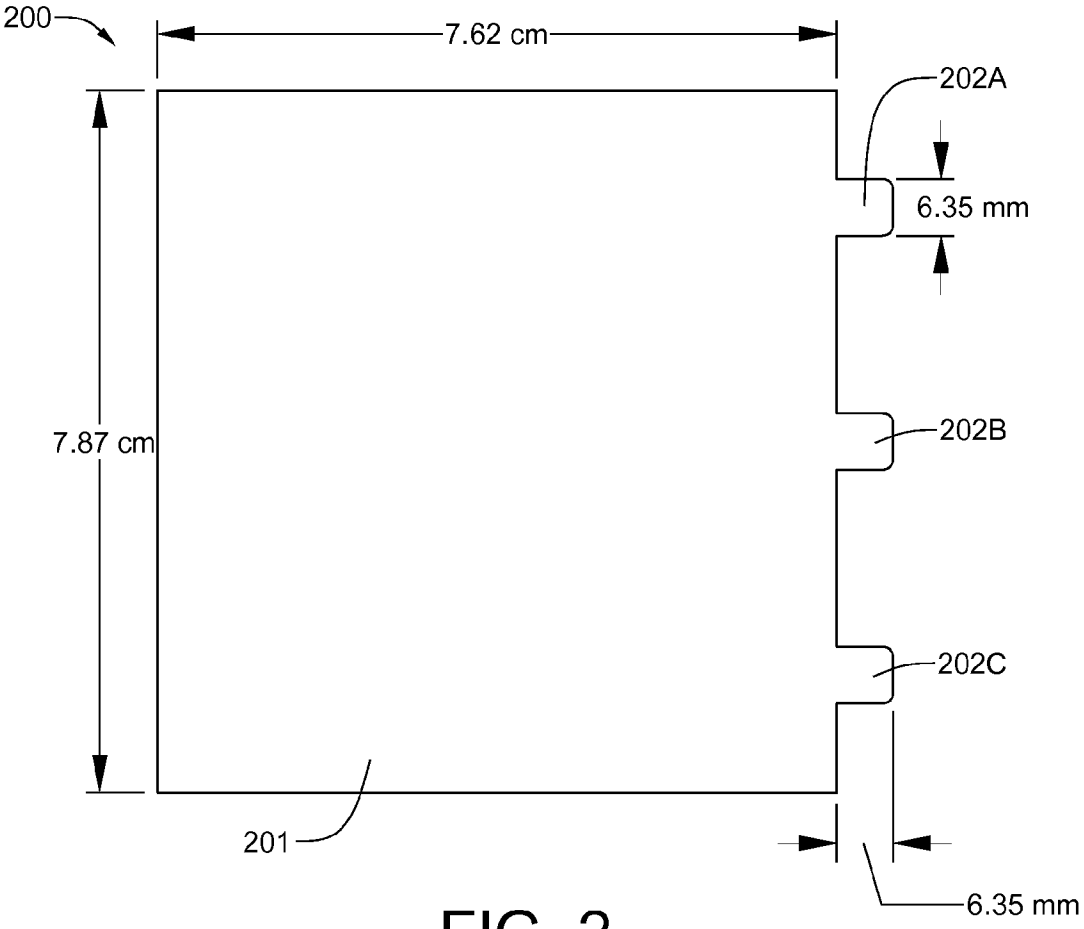
FIG. 2 is a top plan view of the laminar polymer piece from which the tube is made.

Referring now to FIG. 2, the laminar polymeric sheet 200 is shown cut to the proper dimensions. The securing tabs 202A, 202B and 202C are about 6.35 mm (0.25 inch wide) and 6.35 mm (0.25 inch) long, and extend from the right edge of the sheet.

Figure 3:
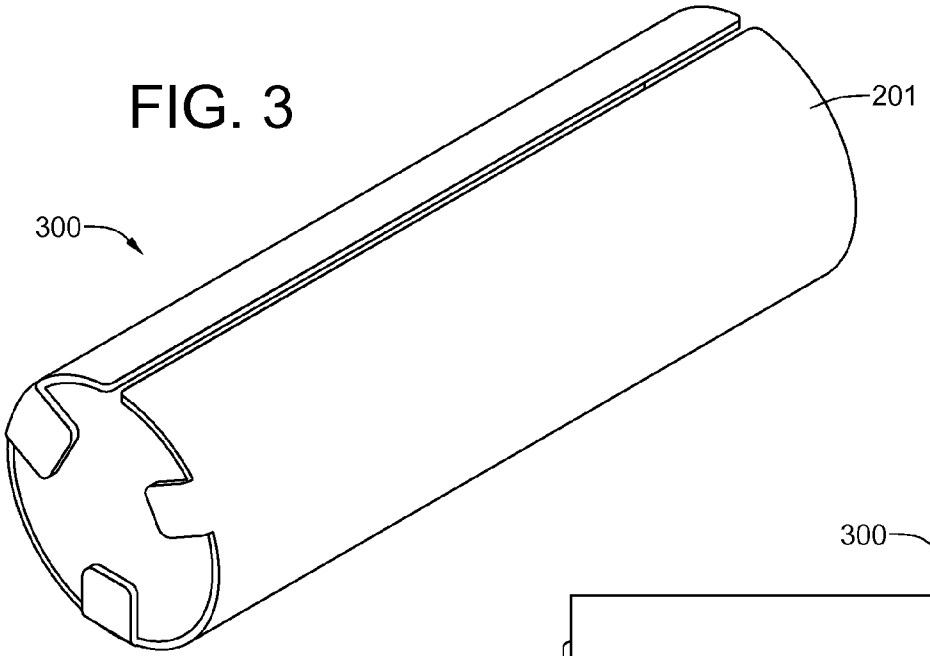
FIG. 3 is an isometric view of the rolled polymeric sleeve.
Figure 5:
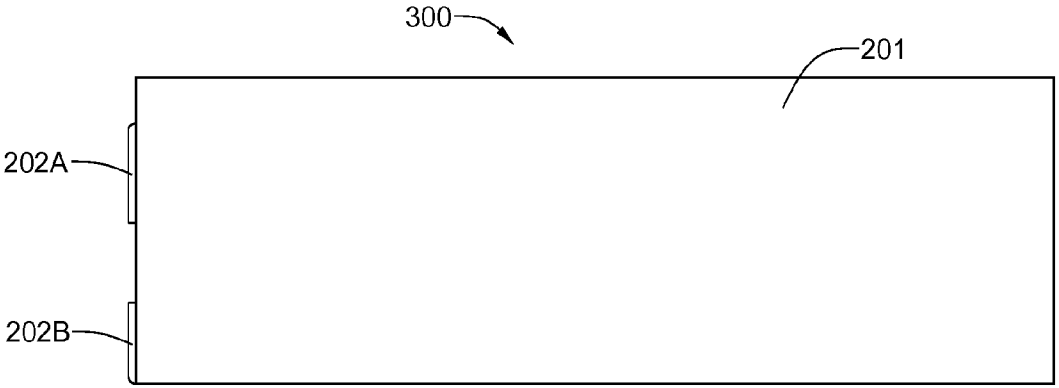
FIG. 5 is a side elevational view of the laminar polymer piece following inwardly bending each of the securing tabs and rolling the piece into a tubular shape.

Referring now to FIG. 3, the polymeric sleeve is shown in perspective or isometric view that shows how the sheet of FIG. 5 has been rolled into a tube 300. It will be noted that there are three securing tabs 202A, 202B and 202C on one end of the tube 200.

Figure 4:
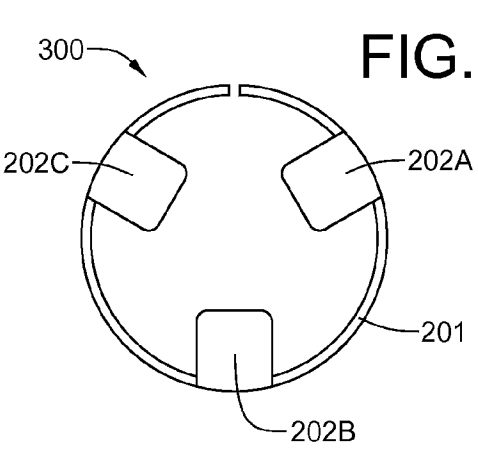
FIG. 4 is a rear end elevational view of the rolled polymeric sleeve.

Referring now to FIG. 4, this end view of the rolled-up sleeve 300 clearly shows its tubular nature. In addition, the three equiangularly-spaced securing tabs 202A, 202B and 202C are clearly visible in this view.

Referring now to FIG. 5, the rolled-up sleeve 300 appears to be a rectangle in this side view. The edges of the folded securing tabs are also visible in this view.

Because generally interchangeable receiver extensions manufactured by different manufacturers vary slightly in internal diameter (though, the polymeric sleeve is preferably fabricated from a generally rectangular piece of laminar polymer material that is subsequently rolled into a tube. The width of the piece of laminar polymer material is sized so that a small gap averaging about 0.9 mm (0.035 inch) wide will remain between the adjacent edges of the rolled sheet, no matter from which manufacturer the receiver extension has been procured. If all receiver extensions had identical internal diameters, the sleeve could just as well be formed from a tube having a continuous cylindrical wall (i.e., no gap). For a presently preferred embodiment of the invention, the sleeve is fabricated from polyvinylchloride (PVC) sheeting having a uniform thickness of about 0.3556-0.381 mm (0.014-0.015 inches). Although a prototype sleeve has been fabricated from PVC sheeting, other polymeric materials such as polyester (PE), high-density polyethylene (HDPE), low-density polyethylene (LDPE), polypropylene (PP), and nylon can also be used to manufacture the sleeve. The nominal internal diameter of the tubular receiver extension for the AR-15 rifle is 2.54 cm (1.00 inch). The presently preferred length of the polymeric sleeve 300 is about 7.62 cm (3.0 inches). The presently preferred width of the laminar polymer material from which the sleeve is made is 7.869 cm (3.098 inches). Each of the securing tabs 202A, 202B and 202C on the rear edge of the laminar polymer material are about 6.35 mm (0.25 inch wide) and 6.35 mm (0.25 inch) long. The securing tabs are positioned so that they will be generally equiangularly spaced about the circumference of the rolled tube 300. In order to impart the proper curvature to the flat laminar material, the rectangular sheet 201 is wrapped around a mandrel of the appropriate diameter, secured to the mandrel with several equally-spaced rubber bands, then mandrel and the rolled sheet are dipped for about 20 seconds into boiling water. Following the hot water dip, the mandrel and rolled sheet are dipped into ice water, which sets the shape of the rolled sheet 201. When the rubber bands are removed and the rolled sheet is slid off the mandrel, it retains its desired cylindrical shape with a narrow slit between the adjacent edges.

During assembly of the rifle action, the polymeric sleeve 200 is inserted into the tubular receiver extension 101 before the action spring 102 and buffer are installed therein. The three inwardly bent securing tabs 202A, 202B and 202C at the rear of the sleeve 200 are held against the closed, rear end of the receiver extension 101 by the action spring 102, whether the spring 102 is fully compressed or only partially compressed state. Installation of the polymeric sleeve 200 in the rear of the receiver extension 201 of an AR-15, M16, or rifle derived from those designs (all of these rifle types are also referred to herein as AR-10 derivative rifles) dramatically reduces vibration and noise during recoil of the bolt, bolt carrier and buffer against the action spring 202. Use of a rifle so equipped is much more pleasant without the continual loud slap of the action spring against the inside of the receiver extension. In addition, aiming the rifle for successive rounds is easier and more accurate with the vibration significantly damped.

Although only a single embodiment of the polymeric sleeve vibration damper for AR-10 derivative rifles has been shown and described, it will be obvious to those having ordinary skill in the art that changes and modifications may be made thereto without departing from the scope and the spirit of the invention as hereinafter claimed.

What is claimed is:

1. A vibration damper for a gas-operated, direct-impingement rifle of the type having an action spring compressible within a tubular, closed-end receiver extension, the damper comprising a generally cylindrical sleeve, formed from a sheet of laminar polymeric plastic material, which lines substantially all of the interior of the tubular receiver extension, said sleeve absorbing vibrations of the action spring as the action spring is compressed and, subsequently, returns to its original length between firings of the rifle.

2. A vibration damper a gas-operated, direct-impingement rifle of the type having an action spring compressible within a closed-end tubular receiver extension between firings of the rifle, said damper comprising a sleeve formed from a generally rectangular sheet of laminar polymeric plastic material, that has been formed into a generally cylindrical shape having a gap between two adjacent edges of the generally rectangular sheet, said sleeve lining substantially all of an interior surface of the tubular receiver extension, thereby providing a resilient buffer between the action spring and the interior tubular surface of the receiver extension.

3. The vibration dampener of claim 2, which further comprises a plurality of securing tabs, which are unitary with said generally rectangular sheet, said securing tabs having been bent toward one another so that a rear end of the action spring will secure them against a closed end of the receiver extension.

4. The vibration dampener of claim 1, which further comprises a plurality of securing tabs, which are unitary with said generally rectangular sheet, said securing tabs having been bent toward one another so that a rear end of the action spring will secure them against a closed end of the receiver extension.

5. An improved gas-operated rifle of the type having a coiled action spring that is longitudinally compressed within a closed-end tubular receiver extension in order to store kinetic energy as a spent cartridge is ejected following a firing of the rifle and, immediately thereafter, begins to return to its uncompressed length, thereby releasing the stored kinetic energy, which is used to reload the rifle, wherein the improvement consists of a resilient, polymeric liner within the tubular receiver extension that acts as a vibration-absorbing damper between the action spring and an interior surface of the receiver extension as the action spring is rapidly compressed and, subsequently, returns to its uncompressed length.

6. The improved gas-operated rifle of claim 5, wherein the resilient, polymeric liner is a sleeve made from a generally rectangular sheet of laminar polymeric plastic material, that has been formed into a generally cylindrical shape having a gap between two adjacent edges of the generally rectangular sheet, said sleeve lining substantially all of an interior surface of the tubular receiver extension.

7. The improved gas-operated rifle of claim 6, wherein the generally rectangular sheet is equipped with a plurality of securing tabs, which are unitary with said generally rectangular sheet, said securing tabs having been bent toward one another so that a rear end of the action spring will secure them against a closed end of the receiver extension.

* * * * *